United States Patent [19]

Watson

[11] 4,286,641

[45] Sep. 1, 1981

[54] COMBINATION BUSINESS CARD AND KEY STORAGE DEVICE

[76] Inventor: Joe L. Watson, 4602 Okeechobee, Fort Pierce, Fla. 33450

[21] Appl. No.: 93,374

[22] Filed: Nov. 13, 1979

[51] Int. Cl.[3] ..... A45C 11/42

[52] U.S. Cl. ..... 150/40; 206/37

[58] Field of Search ..... 150/40; 206/37, 38, 206/372, 478, 484, 484.2

[56] References Cited

U.S. PATENT DOCUMENTS

| | | | |
|---|---|---|---|
| 1,405,136 | 1/1922 | Ingraham | 150/40 |
| 1,877,909 | 9/1932 | L'enfant | 150/40 |
| 2,125,354 | 8/1938 | Meier | 150/40 X |
| 2,155,014 | 4/1939 | Howe | 150/40 |
| 2,703,596 | 3/1955 | Kromer | 150/40 |
| 3,522,829 | 8/1970 | Weintraub | 150/40 |
| 4,037,716 | 7/1977 | Marks | 150/40 X |

FOREIGN PATENT DOCUMENTS

| | | | |
|---|---|---|---|
| 1266751 | 6/1961 | France | 150/40 |

*Primary Examiner*—Donald F. Norton

*Attorney, Agent, or Firm*—Newton, Hopkins & Ormsby

[57] ABSTRACT

An enclosure for storing one or more keys in singular compartments, said enclosure being sized and shaped as a conventional credit card but used as a business card with the business card information printed on one side of the enclosure. The enclosure is planar shaped and rectangular and includes a clear, plastic face having one or more slits, which are appropriately sized for permitting the insertion or removal of a key through the slit into the enclosure. The enclosure may further include a diagonal heat seal which seals two flexible sheets together to form two separate compartments, one for each key. An alternate embodiment can accommodate up to four keys with two on each side, utilizing four separate key compartments with a slit in the exterior wall for access to each compartment.

5 Claims, 5 Drawing Figures

COMBINATION BUSINESS CARD AND KEY STORAGE DEVICE

BACKGROUND OF THE INVENTION

This invention relates generally to a storage device for holding one or more keys individually which can be used also as a business card or other advertising message bearing surface. One of the problems with keys is the maintenance of a spare key, either on the person or in a predetermined location so that the user may have access to a spare key should other keys be lost or locked in a vehicle, or the like.

Although key carriers are known in the art, they are oftentimes bulky and include chains and connectors and are not suitable for carrying in a wallet or pocketbook. The present invention provides a storage receptacle for one or more individual keys which can be readily carried on the person in a wallet credit card section or credit card case, being small in size and economical for production. In addition, the key holder may include at least one surface that has advertising material and can function as a business card.

SUMMARY OF THE INVENTION

An enclosure for carrying at least one key, the enclosure comprising first and second sheets of flexible material sized in credit card size, approximately 2⅛ inch by 3 5/16 inch. The sheets are joined around their periphery with the enclosure being substantially rectangularly shaped and being sized as a conventional business card. One of the sheets includes at least one slit disposed near one corner, the slit being parallel to the end of the enclosure and having sufficient length to receive the largest diametral portion of a key body.

In one embodiment, the first sheet may be opaque for use as a business card such that printed indicia such as found on a conventional business card or other suitable printed matter or indicia can be imprinted thereon.

The second sheet may be transparent and includes in one embodiment a pair of slits on each near diagonal corners, the slits being sized in length to receive suitable keys. The first sheet is joined to the second sheet along the peripheral edges of the enclosure and along a diagonal line dividing the enclosure into two separate compartments. A separate dividing line, which is heat sealed in one embodiment, joining the first and second sheets together is disposed such that the slits are adjacent the right angle formed. The dividing line extends from a position slightly below opposing diagonal corners. This provides for tapering in each compartment such that the narrow portions of the key body fit into the tapered portion of each compartment.

The slits, however, are disposed somewhat away from the ends of the enclosure such that once the key is inserted therein and is fully contained in each compartment of the enclosure, the key will not be able to fall out without manipulation by the user. Thus, the length of each key holder compartment formed by the near diagonal is such that the key can be inserted past the slit and then allowed while in the enclosure to come again past the slit to prevent its accidental removal. The flexible construction of the sheet materials allows the enclosure to be deformed sufficiently for manipulation of the key relative to the slit for ease in removal of the key when desired by the operator.

In an alternate embodiment, first, second, and third sheets are utilized such that first and second sheets form the exterior of the enclosure and are heat sealed to a third inner sheet in a rectangular shape as described above. Slits will be used on both exterior sheets such that in conjunction with heat sealing near diagonal formation, four compartments are formed for holding a total of four keys.

To use either embodiment for insertion of the key, the narrow key end is merely inserted into the slit and the key body thrust into the enclosure until it is received entirely in the enclosure. The key may then be manipulated relative to the enclosure body so that the head portion or larger portion of the key is slid back past the slit once it is in the enclosure. Thus, this prevents the key from accidently falling out and from exposure outside the enclosure. To remove the key, the key is merely moved in the chamber of the enclosure until the larger portion is adjacent or at the mouth of the slit. The enclosure body may then be deformed sufficiently for grasping the key and removing it when desired.

It is an object of this invention to provide an improved individualized key holder.

It is another object of this invention to provide a storage device for one or more individual keys which can be used to provide information such as a business card or the like in conjunction with a key holder.

It is yet still another object of this invention to provide a key holder which is relatively inexpensive in construction and which firmly holds keys therein until it is desired to withdraw the keys.

And yet another object of this invention is to provide a business card that will not be readily discarded.

In accordance with these and other objects which will be apparent hereinafter, the instant invention will now be described with particular reference to the accompanying drawings.

DESCRIPTION OF THE PREFERRED EMBODIMENT

Figure 1:
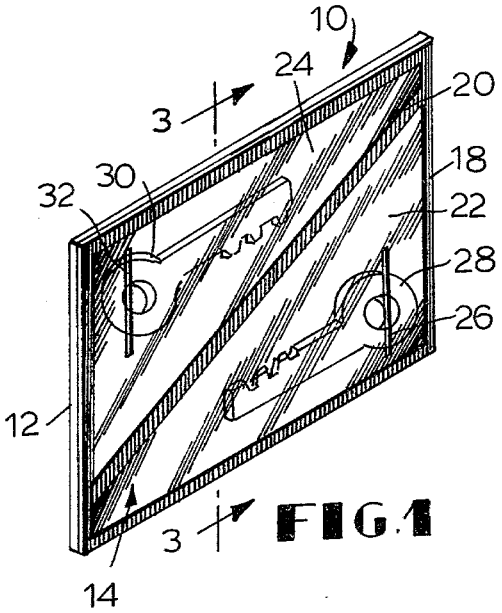
FIG. 1 is a perspective view of the combination business card and key storage device.
Figure 4:
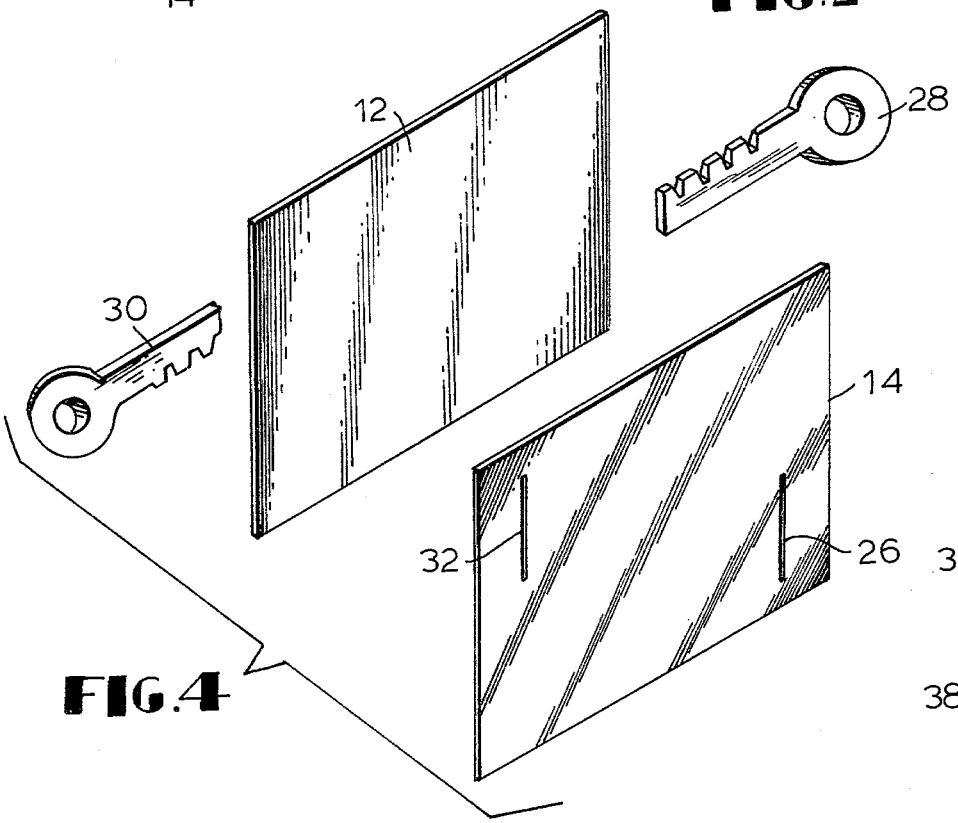
FIG. 4 is an exploded perspective view of the invention.

Referring to FIGS. 1 and 4, a combination business card and key storage device 10 is shown. The combination business card and key storage device 10 is formed by sealing an opaque, flexible sheet 12 to another flexible sheet 14. The preferred method of sealing includes a heat seal 18 between the two flexible sheets 12 and 14 along the outer periphery of the combination business card and key storage device 10 and a heat seal 20 between the two flexible sheets 12 and 14 along a diagonal path from the lower corner of the device 10 to the opposite upper corner of the device 10. The diagonal heat seal 20 divides the device 10 into two compartments 22 and 24. Each compartment 22 and 24 is accessed by a respective slit 26 and 32 cut through the flexible sheet 14. Each slit 26 and 32 is parallel to a respective end of the device 10, but disposed somewhat inward from the respective end of the device 10 to which it is positioned closest.

Two keys, 28 and 30, are inserted through a respective slit 26 or 32 into a respective compartment 22 and 24 for safekeeping.

Figure 2:
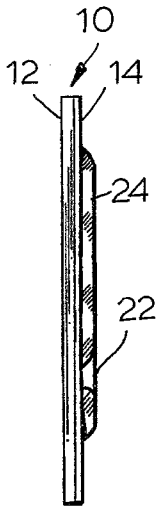
FIG. 2 is an end view of the invention.
Figure 3:
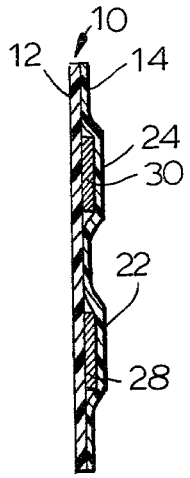
FIG. 3 is a cross-sectional view of the invention taken across the line 3 of FIG. 1 and looking in the direction of the arrows.

FIGS. 2 and 3 show the device 10 having the keys 28 and 30 inserted into the respective compartments 22 and 24.

Figure 5:
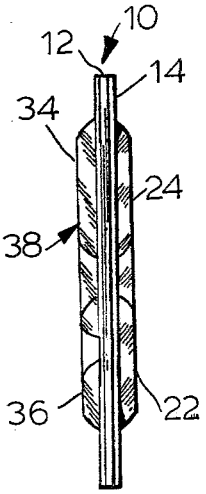
FIG. 5 is an end view of another embodiment of the invention.

FIG. 5 shows another embodiment of the device 10. In addition to flexible sheets 12 and 14, a flexible sheet 38 is used. Flexible sheet 38 has two slits similarly located as the slits in flexible sheet 14. Flexible sheet 38 is heat sealed around its periphery to flexible sheet 12 in the same manner as flexible sheet 14. An additional two keys can be accommodated in the compartments 34 and 36.

Referring back to FIG. 1, it is noted that in each compartment formed by the heat seal 20 (almost diagonal) is such that the heat seal line 20 does not extend truly from corner to corner. The offset as shown allows for spacing of the narrow end of the key in the compartment when pushed against the respective side wall. The purpose of this is such that each compartment is larger then the key itself so that when the key is inserted through either slit, it may be pushed all the way forward sufficiently to allow its entry into the compartment and then pushed backward into position as shown in FIG. 1 so that the entire key body is within the compartment, and there is no danger of the key falling out through the slit without manipulation of the flexible material. Again, this is accomplished by sliding the key forward sufficiently so that the larger ring can then be manipulated through the slit for removal of the key.

Another advantage of using the device as a business card which can have indicia on opaque sheet 12 is that the person can retain a business card and the information thereupon and at the same time retain additional keys conveniently without using a key chain.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved key holder device, comprising:

an enclosure having a first outer surface and a second outer surface joined together around their periphery, one of said surfaces including a receiving means for inserting a key into said enclosure;

said enclosure including at least two substantially rectangular flexible sheets;

said substantially rectangular flexible sheets including a first seal around the peripheral edges of said substantially rectangular flexible sheets and a second seal along a diagonal of said substantially rectangular flexible sheets dividing said first outer surface into a first substantially triangular compartment and a second substantially triangular compartment;

said first substantially triangular compartment and said second substantially triangular compartment each having a wide end and a narrower end;

said receiving means including a slit formed in the wide end of at least one of said substantially triangular compartments.

2. An improved key holder device as set forth in claim 1, wherein:

said first seal is a heat seal; and said second seal is a heat seal.

3. An improved key holder device as set forth in claim 1, wherein:

said enclosure is the size and shape of a business card, and includes an external surface suitable for receiving printed indicia thereupon.

4. An improved key holder device as set forth in claim 1, wherein:

said second outer surface of said enclosure is opaque for receiving printed indicia thereon.

5. An improved key holder device comprising: a first rectangular flexible sheet and second and third rectangular flexible sheets, all of similar size, laminated together with the said first sheet interposed between the said second and third sheets and all three said sheets heat sealed on their outer peripheries and on a diagonal line between two opposite rectangular corners, thereby dividing said sheets into first and second substantially triangular compartments between said first and second sheets and into third and fourth substantially triangular compartments between said first and third sheets, said second and third sheets each having two laterally disposed slits parallel to the short sides of the said rectangular sheets and each slit being spaced inwardly from its adjacent short side, each slit thereby providing access to one of the four said substantially triangular compartments.

* * * * *